US005523821A

United States Patent [19]

Chang et al.

[11] Patent Number: 5,523,821

[45] Date of Patent: Jun. 4, 1996

[54] MOBILE COPY MACHINE EXTENSION UNIT

[75] Inventors: Joseph Chang; Shih-Chin Chang; C. Y. Chang, all of Hsin Chu, Taiwan

[73] Assignee: Advanced Scientific Corp., Hsin Chu, Taiwan

[21] Appl. No.: 357,590

[22] Filed: Dec. 16, 1994

[51] Int. Cl.[6] ..... G03G 15/00

[52] U.S. Cl. ..... 355/200; 355/202; 355/210; 355/308

[58] Field of Search ..... 355/200, 202, 355/210, 308, 309, 321; 271/3.01, 4.01, 3.14

[56] References Cited

U.S. PATENT DOCUMENTS 5,103,261 4/1992 Matsuo et al. ..... 355/210
5,146,270 9/1992 Matsuo et al. ..... 355/200
5,258,809 11/1993 Wiedemer ..... 355/200
5,345,295 9/1994 Takano et al. ..... 355/200 X
5,420,701 5/1995 Terashima et al. ..... 355/308 X
5,450,159 9/1995 Choi et al. ..... 355/200

*Primary Examiner*—Matthew S. Smith

[57] ABSTRACT

A mobile copy machine extension unit including a casing having a paper tray for holding blank sheets of paper, a front cover and a back cover mounted on the casing and spaced by a loading space for letting a mobile copy machine to be loaded between the front and back cover, a reversible motor, sheet-transfer rollers turned by the reversible motor through a set of gears to carry individual blank sheets of paper into the mobile copy machine through a paper inlet on the front cover, an idle wheel turned by the reversible motor through a belt transmission to carry copied sheets of paper out of the mobile copy machine to a paper deck on the casing through a paper outlet on the back cover.

3 Claims, 4 Drawing Sheets

MOBILE COPY MACHINE EXTENSION UNIT

BACKGROUND OF THE INVENTION

The present invention relates to a mobile copy machine extension unit which is adapted for use with a mobile copy machine to extend the functions of the copy machine.

There is known a mobile copy machine designed for traveller use (see FIG. 1). The structure of this kind of copy machine is simply comprised of a scanner unit controlled to scan the image of the document to be copied and to convert the scanned image into digital data, and a printer unit controlled to print out the data from the scanner on an individual sheet of paper. The advantage of this structure of copy machine is its mobility. However, this kind of copy machine is not satisfactory in function for using in an office. During the copying operation, only one sheet of paper can be loaded. When to copy a second copy, a second sheet of paper must be manually loaded again and then the start switch of the mobile copy machine must be pressed. Therefore, this structure of mobile copy machine is complicated to operate. Before the operation of the mobile copy machine the document and an individual sheet of paper must be separately and accurately loaded into position. If the document or the sheet of paper are not accurately loaded in position, a copy error will occur. Furthermore, this structure of mobile copy machine uses a rechargeable storage battery to provide the necessary working voltage. The user must frequently check the power level of the rechargeable storage battery.

SUMMARY OF THE INVENTION

The present invention has been accomplished under the circumstances in view. The main object of the present invention is to provide a mobile copy machine extension unit which is designed as a home station of a mobile copy machine to greatly improve the functions for office use. It is one object of the present invention to provide a mobile copy machine extention unit which can be automatically carrying individual sheets of paper into the mobile copy machine and automatically carrying copied sheets of paper out of the mobile machine. It is another object of the present invention to provide a mobile copy machine extension unit which permits a mobile copy machine to continuously copy document. It is still another object of the present invention to provide a mobile copy machine extension unit which provides power supply to the loaded mobile copy machine and charges its rechargeable storage battery.

DETAILED DESCRIPTION OF THE PREFERRED EMBODIMENT

Figure 1:
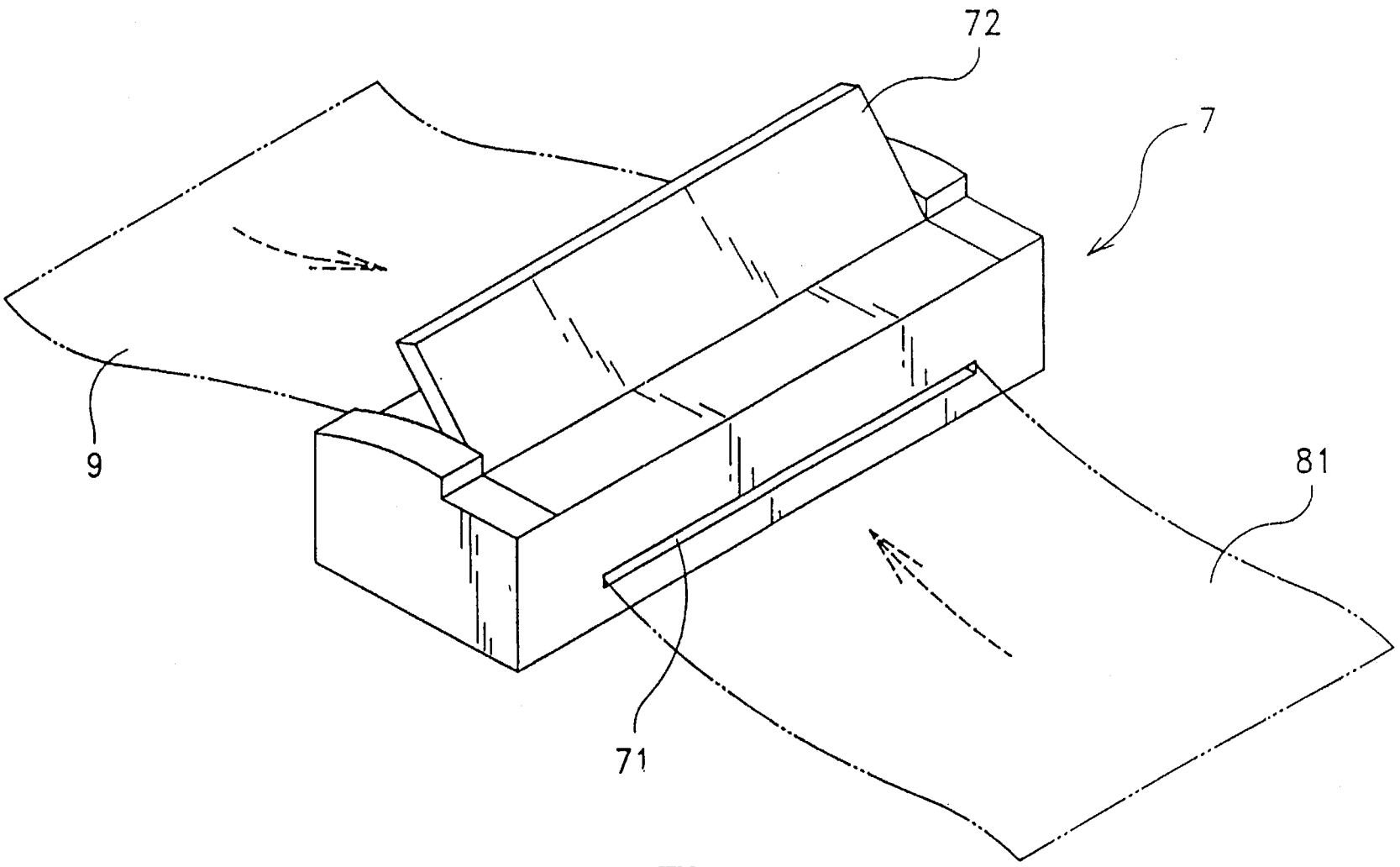
FIG. 1 shows a regular mobile copy machine with which is used in the present invention.

Referring to FIG. 1, a mobile copy machine 7 has a paper feeding port 71 at one side for inserting individual sheets of paper 81, a paper output port 73 at an opposite side (see also FIG. 3) for letting copied individual sheets of paper to be moved out of the mobile copy machine, and a document feeding port (not shown) disposed at the top and covered by a top cover 72 for inserting individual sheets of document 9.

Figure 2:
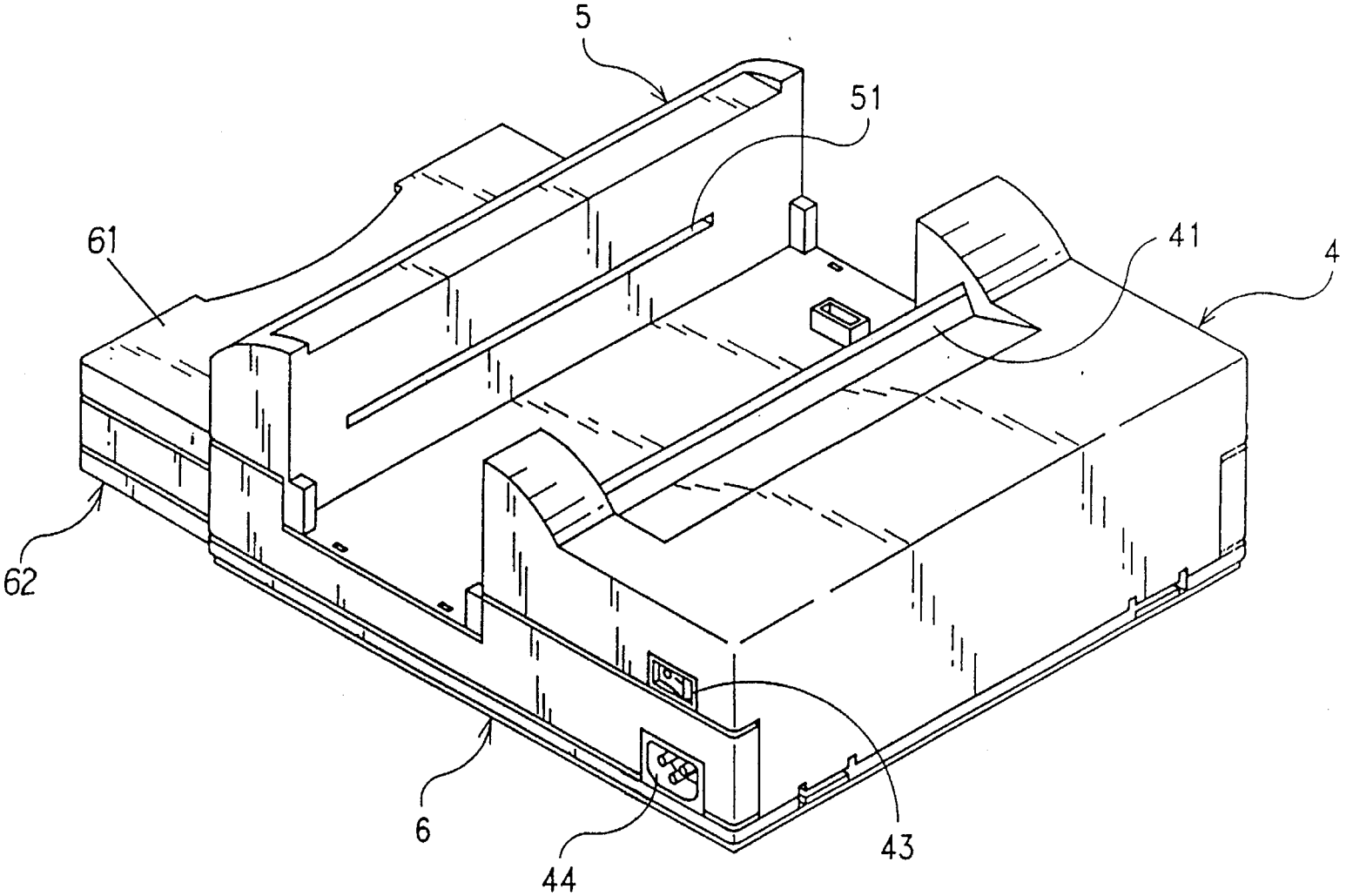
FIG. 2 is an elevational view of a mobile copy machine extension unit.
Figure 3:
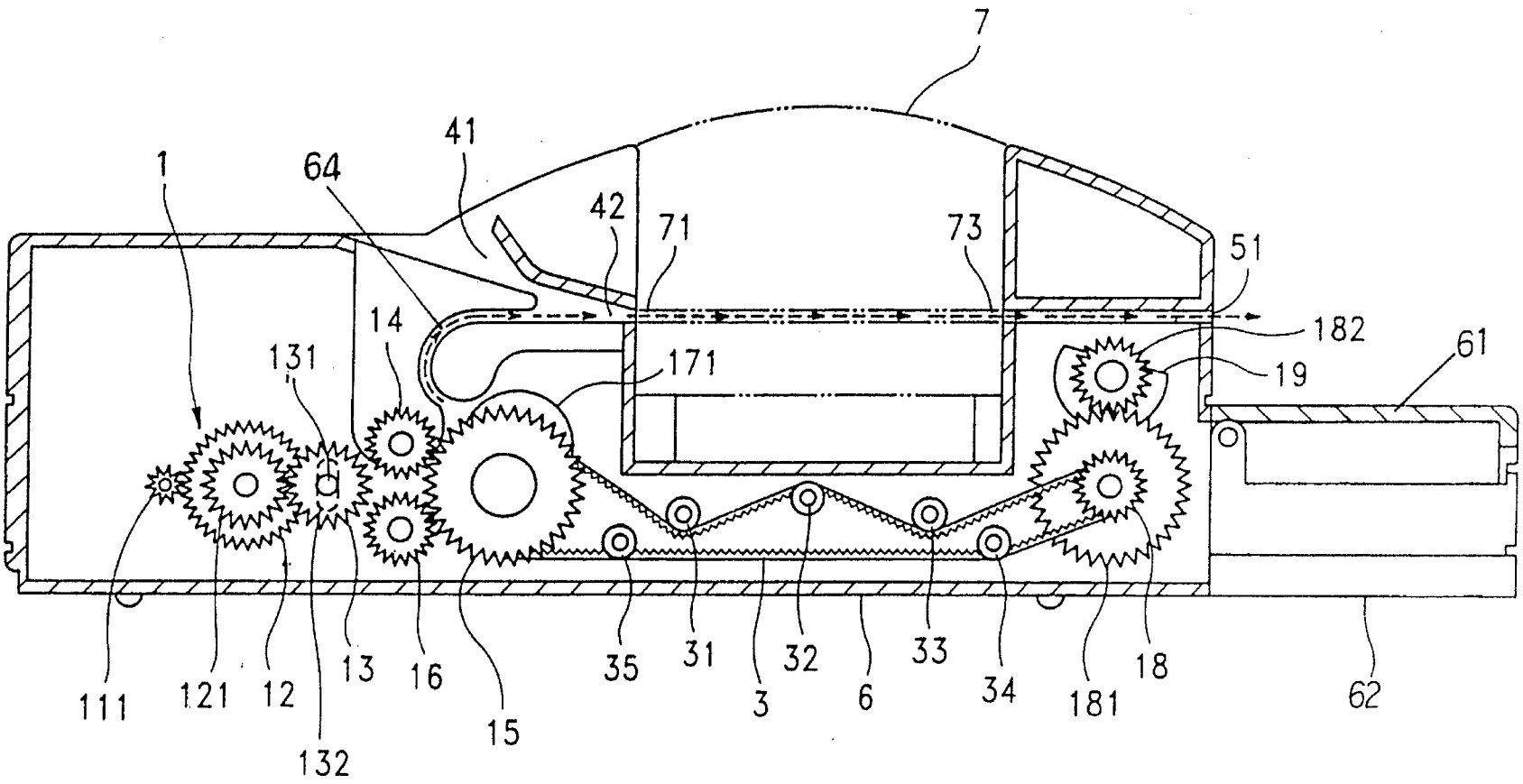
FIG. 3 is a side view in section of the mobile copy machine extension unit shown in FIG. 2, showing the mobile copy machine of FIG. 1 installed.
Figure 4:
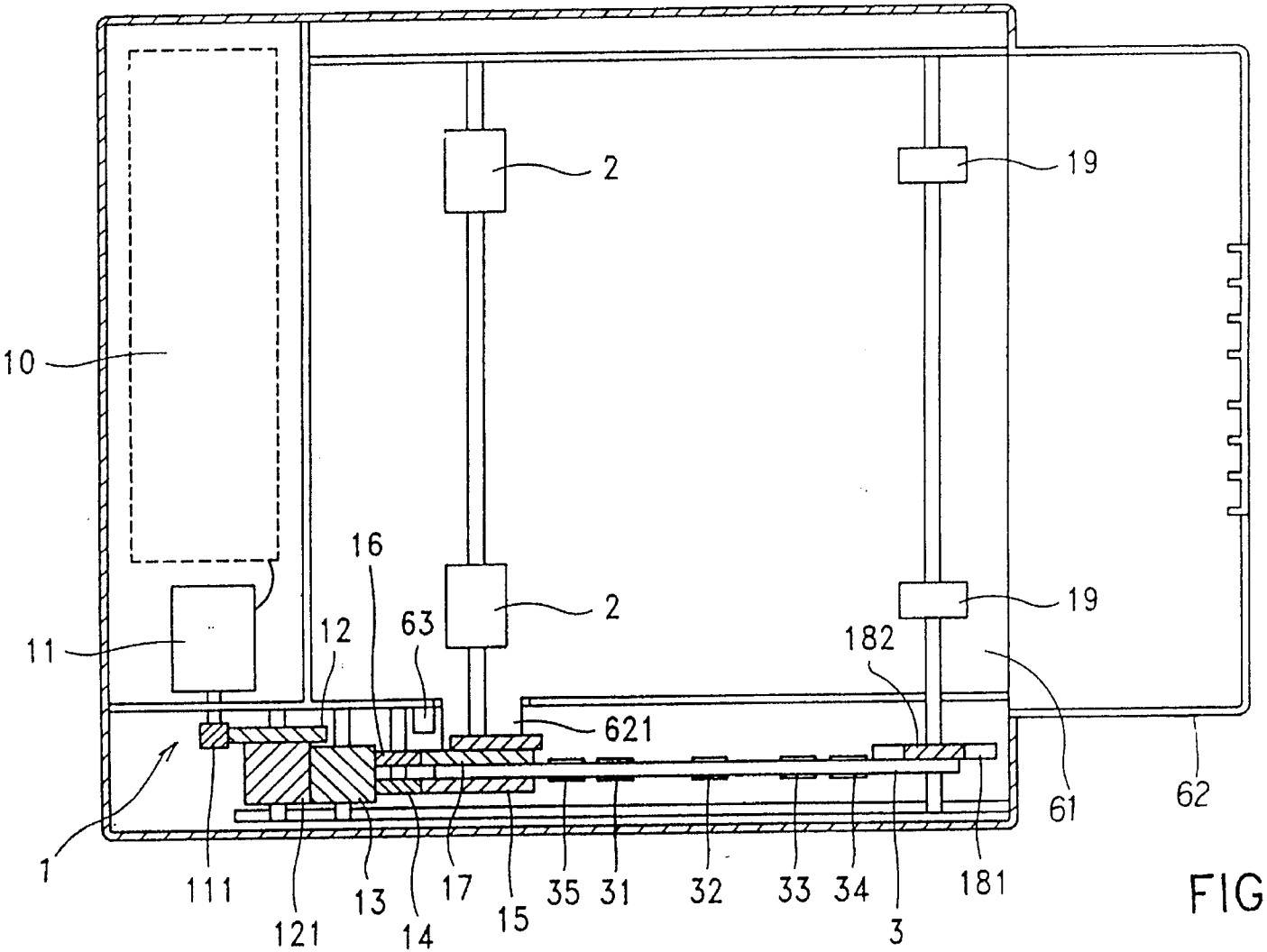
FIG. 4 is a top view in section of the mobile copy machine extension unit shown in FIG. 2.

Referring to FIGS. 2, 3, and 4, a mobile copy machine extension unit in accordance with the present invention is generally comprised of a front cover 4, a back cover 5, a casing 6, a transmission system 1, and a control circuit 10. The transmission system 1 and the control circuit 10 are mounted inside the casing 6. The front cover 4 and the back cover 5 are covered on the casing 6 and spaced from each other formed a "U" shaped loading space 70 therein. The distance between the front cover 4 and the back cover 5 is approximately equal to the width of the mobile copy machine 7. Therefore, the mobile copy machine 7 can be inserted in between the front cover 4 and the back cover 5. The front cover 4 has a single-sheet paper feeding port 41 and a paper inlet 42 in communication with the single-sheet paper feeding port 41 for a manual feeding operation. The back cover 5 has a paper outlet 51. When the mobile copy machine 7 is inserted in between the front cover 4 and the back cover 5, the paper inlet 42 of the front cover 4 and the paper outlet 51 of the back cover 5 are disposed in communication with the paper feeding port 71 and paper output port 73 for the mobile copy machine 7. The casing 6 comprises a copied paper deck 61 at the back side for collecting copied sheets of paper, a paper tray 62 disposed on the side for holding blank sheets of paper and a curved path 64 on a front of the paper tray 62 for passing the blank sheets of paper into the passer inlet 42 in the front cover 4 during an automatic feeding operation.. Sheet-transfer rollers 2 are disposed inside the casing 6 and controlled to move an individual blank sheet of paper from the paper tray 62 through the curved path 64 into the paper inlet 42 and the paper feeding port 71. A control switch 43 is made on the front cover 4 at one side for controlling the operation of the extension unit. An electric socket 44 is made on the casing 6 at one side for the connection of AC power supply for operating the whole system and/or for charging the rechargeable storage battery of the mobile copy machine 7 when the mobile copy machine 7 is loaded.

The transmission system 1 comprises a reversible motor 11. When the reversible motor 11 is turned clockwise, a pinion 111 is driven to turn a big transmission gear 12 counter-clockwise, causing a small transmission gear 121 to move a sliding gear 13 upwards. The sliding gear 13 has a gear shaft 131 disposed in an elongated slot 132. When the sliding gear 13 is moved upwards, it immediately meshes with an upper gear 14, causing the upper gear 14 turned counter-clockwise. When the upper gear 14 is turned counter-clockwise, a front gear 15 is driven by the upper gear 14 to turn the sheet-transfer rollers 2 clockwise, causing an individual blank sheet of paper moved out of the paper tray 62 into the paper inlet 42 through the curved path 64. When the reversible motor 11 is turned counter-clockwise, the pinion 111 is driven to turn the big transmission gear 12 clockwise, causing the small transmission gear 121 (which is fixedly fastened to the gear shaft of the big transmission gear 12) to move the sliding gear 13 downwards. When the sliding gear 13 is moved downwards, it becomes disengaged from the upper gear 14 and then meshed with a lower gear 16, causing the lower gear 16 turned clockwise. When the lower gear 16 is turned clockwise, a back gear 17 is driven by the lower gear 16 to turn a cam 171 counter-clockwise. When the cam 171 is turned counter-clockwise, it will be pressed on a projecting portion 621 of the paper tray 62 to move the paper tray 62 downwards from the sheet-transfer rollers 2. Therefore, the sheet-transfer rollers 2 are stopped from sending individual blank sheets of paper to the paper inlet 42. When the cam 171 is pressed against the projecting portion 621, the back gear 17 turns a transmission belt 3 counter-clockwise, causing it to turn a step gear 18 counter-clockwise. When the step gear 18 is turned counter-clockwise, the big gear portion 181 of the step gear 18 is synchronously turned to rotate a driving gear 182, causing it to turn an idle wheel 19 in carrying the copied sheet of paper out of the paper outlet 51 to the copied paper deck 61. The outer diameters of the big transmission gear 12 and the idle wheel 19 are so made that the idle wheel 19 is turned through two revolutions when the big transmission gear 12 is turned through a half revolution. Furthermore, there are guide rollers 31, 32, 33, 34, 35 disposed inside the casing 6 and pressed on the transmission belt 3 to guide its movement.

If the top cover 72 of the mobile copy machine 7 is not closed, the reversible motor 11 does no work. When the top cover 72 is closed, and the start switch (not shown) of the mobile copy machine 7 is switched on, the reversible motor 11 is started and turned clockwise, causing an individual blank sheet of paper delivered from the paper tray 62 through the curved path 64 and the paper inlet 42 into the paper feeding port 71 of the mobile copy machine 7. When an individual blank sheet of paper is carried into the mobile copy machine 7 in place, the reversible motor 11 is stopped. After a pre-set length of time, the reversible motor 11 is turned counter-clockwise to carry the well copied sheet of paper from the paper output port 73 through the paper outlet 51 to the copied paper deck 61. Furthermore, there is an inductor 63 disposed at one side by the paper tray 62. When the paper tray 62 is forced down by the cam 171, the inductor 63 is induced to give a signal to the control circuit 10, causing it to stop the reversible motor 11.

While only one embodiment of the present invention has been shown and described, it will be understood that various modifications and changes could be made without departing from the spirit and scope of the invention.

What is claimed is:

1. A mobile copy machine extension unit controlled to automatically feed blank sheets of paper individually into a mobile copy machine being loaded and to automatically carry copied sheets of paper from said mobile copy machine for collection, the mobile copy machine extension unit comprising:

a casing comprising a paper deck at a back side for collecting copied sheets of paper, a paper tray on an inside for carrying blank sheets of paper;

a front cover mounted on said casing at one side, said front cover comprising a single-sheet paper feeding port, into which individual blank sheets of paper can be fed sheet by sheet, a paper inlet communicated with said single-sheet paper feeding port for letting individual blank sheets of paper to be individually carried into said mobile copy machine;

a back cover mounted on said casing at an opposite side, and defining with said front cover a "U" shaped loading space for holding said mobile copy machine, said back cover having a paper outlet for letting copied sheets of paper to be carried from said mobile copy machine to said paper deck;

a transmission system including a paper input transmission mechanism controlled to carry individual blank sheets of paper from said paper tray to said mobile copy machine through said paper inlet of said front cover, and a paper output transmission mechanism controlled to carry copied sheets of paper out of said mobile copy machine through said paper outlet of said back cover to said paper deck, said paper input transmission mechanism comprising a reversible motor, a pinion turned by said reversible motor, a big transmission gear turned by said pinion, a small transmission gear turned by said big transmission gear, a sliding gear moved vertically by said small transmission gear, an upper gear turned by said sliding gear when said sliding gear is moved to an upper limit position upon forward rotation of said reversible motor, a front gear turned by said upper gear, sheet-transfer rollers turned by said front gear to carry individual blank sheets of paper out of said paper tray into said mobile copy machine through said paper inlet of said front cover, said paper output transmission mechanism comprising a lower gear turned by said sliding gear when said sliding gear is moved to a lower limit position upon reverse rotation of said reversible motor, a back gear turned by said lower gear, a cam turned by said back gear to press said paper tray causing said paper tray to move downwards from said sheet-transfer rollers, a transmission belt turned by said front gear upon reverse rotation of said reversible motor, a step gear turned by said transmission belt, a driving gear turned by said step gear, and an idle wheel turned by said driving gear to carry copied sheets of paper out of said mobile copy machine to said paper deck individually;

a control circuit for controlling the operation of said reversible motor of said transmission system, said control circuit comprising an inductor, which gives a signal to stop said reversible motor from rotation when said paper tray is forced downwards by said cam, a control switch made on said front cover at one side for operation control,and an electric socket made on said casing at one side for connecting the AC power supply to operate the whole system and/or to charge a rechargable storage battery of said mobile copy machine.

2. The mobile copy machine extension unit of claim 1 wherein said big transmission gear and said idle wheel are so made that said idle wheel is turned through two revolutions when said big transmission gear is turned through a half revolution.

3. The mobile copy machine extension unit of claim 1 wherein said paper output transmission mechanism of said transmission system further comprises a plurality of guide rollers disposed inside said casing and pressed on said transmission belt to guide its movement.

* * * * *